United States Patent [19]

West et al.

[11] Patent Number: 4,500,439

[45] Date of Patent: Feb. 19, 1985

[54] HYDROCARBON-SOLUBLE POLYAMINE-MOLYBDENUM COMPOSITIONS, LUBRICANTS AND GASOLINE CONTAINING SAME

[75] Inventors: C. Thomas West; Robert J. Basalay, both of Naperville, Ill.

[73] Assignee: Standard Oil Company (Indiana), Chicago, Ill.

[21] Appl. No.: 542,011

[22] Filed: Oct. 14, 1983

Related U.S. Application Data

[60] Continuation of Ser. No. 301,752, Sep. 14, 1981, abandoned, which is a division of Ser. No. 190,590, Sep. 25, 1980, Pat. No. 4,357,149.

[51] Int. Cl.[3] ..... C10M 1/54

[52] U.S. Cl. ..... 252/46.4; 44/68; 44/76; 260/429 R

[58] Field of Search ..... 252/46.4, 49.7; 260/429 R, 132, 135; 44/68, 76

[56] References Cited

U.S. PATENT DOCUMENTS

| | | | |
|---|---|---|---|
| 2,459,114 | 1/1949 | Oberright | 252/42.7 |
| 2,938,869 | 5/1960 | Hugel | 252/46.4 |
| 3,010,902 | 11/1961 | Spengler et al. | 252/49.7 X |
| 3,223,625 | 12/1965 | Cyphers et al. | 252/18 |
| 3,281,355 | 10/1966 | Cyphers et al. | 252/46.4 X |
| 3,419,589 | 12/1968 | Larson et al. | 252/49.7 X |
| 3,509,051 | 4/1970 | Farmer et al. | 252/46.4 X |
| 4,263,152 | 4/1981 | King et al. | 252/46.4 |
| 4,265,773 | 5/1981 | de Vries et al. | 252/46.4 |
| 4,272,387 | 6/1981 | King et al. | 252/46.4 |
| 4,285,822 | 8/1981 | de Vries et al. | 252/46.4 |

FOREIGN PATENT DOCUMENTS

| | | | |
|---|---|---|---|
| 1085903 | 10/1967 | United Kingdom | 252/49.7 |
| 2037317A | 7/1980 | United Kingdom | 252/49.7 |

*Primary Examiner*—Andrew Metz

*Attorney, Agent, or Firm*—William C. Clarke; William T. McClain; William H. Magidson

[57] ABSTRACT

Molybdenum compositions suitable for improving the properties of lubricants and fuels comprise the reaction product of molybdenum and a polyamine Mannich reaction product, a polyamine hydrocarbyl-substituted dicarboxylic acid compound reaction product, and the oxidized and/or sulfurized reaction products thereof.

3 Claims, No Drawings

HYDROCARBON-SOLUBLE POLYAMINE-MOLYBDENUM COMPOSITIONS, LUBRICANTS AND GASOLINE CONTAINING SAME

This is a continuation of application Ser. No. 301,752, filed on Sept. 14, 1981, now abandoned which is a division of application Ser. No. 190,590, filed on Sept. 25, 1980, and now U.S. Pat. No. 4,357,149.

This invention relates to hydrocarbon-soluble polyamine-molybdenum compositions, means for preparation of the molybdenum compositions, and the use of the molybdenum compositions in hydrocarbons such as gasolines, lubricating oils, fuels, etc.

Molybdenum compounds are well known for improving the properties of both fuels and lubricants. Recently, hydrocarbon-soluble molybdenum compounds and preferably hydrocarbon-soluble molybdenum (VI) compounds have been shown, in U.S. Ser. No. 190,591 filed Sept. 25, 1980 and now abandoned for continuation-in-part application Ser. No. 331,608 filed Dec. 17, 1981 and U.S. Ser. No. 190,592 filed Sept. 25, 1980 and now abandoned for continuation-in-part application Ser. No. 362,317 filed Mar. 26, 1982, to be effective in suppressing octane requirement increase in gasolines. Lubricating oils containing soluble molybdenum are known for reducing friction between moving parts in internal combustion engines which improves fuel economy.

A great number of hydrocarbon-soluble molybdenum-containing compositions have been disclosed in the art including water soluble molybdenum-amine complexes, W. F. Marzluff, *Inorg. Chem.* 3, 345 (1964), molybdenum-oxazoline complexes, U.S. Pat. No. 4,176,074, and molybdenum lactone oxazoline complexes, U.S. Pat. No. 4,176,073, molybdenum beta-keto esters, molybdenum-olefin-carbonyl complexes, molybdenum-amide complexes, molybdenum diorganophosphates, U.S. Pat. No. 4,178,258, molybdenum diorganodithiophosphates, molybdenum carboxylates, molybdenum dithiocarbamates, etc. While these compositions can improve the characteristics of fuels and lubricants, they suffer the drawback that they are often uneconomical or difficult to prepare, contain phosphorus which can poison catalytic convertors or produce unwanted interactions with other additive compositions which can reduce the overall benefit to the fuel or lubricant.

Accordingly, a need exists for hydrocarbon-soluble molybdenum compositions which can be economically prepared, and which can provide high activity to hydrocarbon compositions.

The general object of this invention is to improve the properties of fuels and lubricants with hydrocarbon-soluble molybdenum compositions. Another object of this invention is to provide improved hydrocarbon-soluble molybdenum compositions that are inexpensive to prepare and highly active in hydrocarbon solution. Other objects appear hereinafter.

We have discovered improved hydrocarbon soluble molybdenum compositions which comprise the reaction product of a molybdenum compound and a hydrocarbon-soluble polyamine compound selected from the group consisting of polyamine Mannich products, substituted dicarboxylic acid compound-polyamine reaction products, and the oxidized and/or sulfurized products thereof.

A first aspect of the invention is the reaction product of a molybdenum compound and a hydrocarbon soluble polyamine compound. Another aspect of the invention is the sulfurized and/or oxidized reaction product of a molybdenum compound and a hydrocarbon soluble polyamine compound. Still another aspect of the invention is the reaction product of a molybdenum compound and the sulfurized and/or oxidized hydrocarbon soluble polyamine compound.

Molybdenum compounds useful for preparing the novel hydrocarbon soluble molybdenum compositions of this invention are those which produce ammonium molybdate, molybdic acid including iso- and heteropoly molybdic acid, and molybdic oxide under reaction conditions. For Octane Requirement Increase suppression molybdenum(VI) or hexavalent molybdenum is preferred. Such compounds include ammonium, molybdate, molybdenum oxides; Group I metal, Group II metal, or ammonium salt of molybdic acid including sodium molybdate, potassium molybdate, magnesium molybdate, calcium molybdate, barium molybdate, ammonium molybdate, etc. Preferably, molybdenum trioxide (molybdic anhydride), molybdic acid or ammonium molybdate are used for reasons of reactivity, low cost, and availability. Other compounds of molybdenum such as molybdenum pentahalide, molybdenum dioxide, molybdenum sesquioxide, ammonium thiomolybdate, ammonium bismolybdate, ammonium heptamolybdate tetrahydrate, etc., can also be employed. Other molybdenum compounds which can be used in this invention are discussed in U.S. Pat. Nos. 2,753,306; 3,758,089; 3,104,997; and 3,256,184, which are expressly incorporated by reference herein.

Hydrocarbon-soluble polyamines which can be used to solubilize molybdenum compounds in hydrocarbon compositions include polyamine Mannich products and substituted dicarboxylic acid compound-polyamine reaction products which can also be sulfurized and/or oxidized.

Polyamine Mannich reaction products useful in solubilizing molybdenum compounds include the reaction product of a substantially hydrocarbon compound having at least one active or acidic hydrogen such as an oxidized olefinic polymer or an alkylphenol compound, a polyamine, and a carbonyl-containing compound such as formaldehyde or a formaldehyde-yielding reagent.

Polyamine Mannich products prepared from oxidized olefinic polymers are discussed in detail in Culbertson U.S. Pat. No. 3,872,019 and West U.S. Pat. No. 4,011,380 which are expressly incorporated by reference herein.

Culbertson, et al., U.S. Pat. No. 3,872,019 issued Mar. 18, 1975, discloses and claims bifunctional lubricant additives exhibiting both dispersant and viscosity index improving properties obtained by the Mannich condensation of an oxidized long chain, high molecular weight amorphous copolymer of essentially ethylene and propylene having a number average molecular weight of at least about 10,000 and at least 140 pendant methyl groups per 1,000 chain carbon atoms with a formaldehyde yielding reactant and a polyamine, said reactants being employed in the molar ratio of from about 1:2:2 to about 1:20:20, respectively.

West, et al., U.S. Pat. No. 4,011,380 issued Mar. 8, 1977, discloses and claims oxidation of polymers of ethylene and olefinic monomers in the temperature range of from about −40° F. to about 800° F. The oxidation is carried out in the presence of about 0.05 wt.% to about 1.0 wt.% based on the copolymer oil solution, of an oil soluble benzene sulfonic acid or salt thereof. These benzene sulfonic acids enhance the rate of oxidation reaction and often lighten the color of the oxidized product. In West, U.S. Pat. No. 4,131,553 alkylbenzene-sulfonic acid catalyzed Mannich reaction products are shown to have improved dispersancy/high-temperature cleanliness.

The alkyl phenol compounds useful in this invention for preparing polyamine Mannich reaction products are commonly paramonoalkyl-substituted phenols which are made by the reaction of about 1 to 20 moles of phenol with 1 mole of a polyolefin in the presence of an alkylating catalyst. The most common alkylating catalysts are boron trifluoride ($BF_3$, including etherate, phenolate, or other complexes, and hydrogen fluoride (HF) if present), acidic activated clays, strong ionic exchange resins, etc. The process is particularly effective when conducted by reacting 3 to 7, or preferably 5, moles of phenol to about 1 mole of polyolefin in the presence of the catalyst. The product is conveniently separated from the catalyst by filtration or decantation. Unreacted phenol is removed by distillation leaving as a residue the product which commonly comprises a paramono-substituted alkyl phenol containing some unreacted polyolefin. Examples of useful polyolefin alkylating agents are polyethylene, poly-1-butene, polyisobutylene, polypropylene, etc., having a molecular weight from about 600 to about 3,200 and greater. These olefinic polymers are well known and can be produced by well-known liquid phase polymerization of olefinic monomers such as ethene, propene, butene, isobutylene, amylene, etc.

Commonly available formaldehyde-yielding reagents can be used in the Mannich reaction. Examples of formaldehyde-yielding reagents are formalin, gaseous formaldehyde, paraformaldehyde, trioxane, trioxymethylene, other formaldehyde oligomers, etc.

The polyamine reactant useful in the preparation of the Mannich reaction products include amine compounds containing at least two nitrogen atoms separated by at least an ethylene group, having at least one primary or secondary nitrogen. Preferred polyamines have the general formula $NH_2[(CH_2)_ZNH]_xH$ wherein Z is an integer from 2 to 6 and x is an integer from 1 to about 10. Illustrative of suitable polyamines are ethylene diamine, trimethylenediamine, tetramethylenediamine, hexamethylenediamine, diethylenetriamine, triethylenetetraamine, tetraethylenepentamine, tripropylenetetraamine, tetrapropylenepentamine, and other polyalkylene polyamines in which the alkylene group contains about 12 carbon atoms. Other useful polyamines include bis(amino-alkyl)-piperazine, bis-(amino-alkyl)-alkylene diamine, bis(amino-alkyl) ethylene diamine, bis(amino-alkyl)-propylene diamine, N-aminoalkyl-morpholine, 1,3 propane polyamines, and polyoxyalkyl polyamines.

Mannich reaction products can be prepared by the reaction of a polyamine, a formaldehyde-yielding reagent, and an alkyl phenol or an oxidized olefinically unsaturated polymer optionally in the presence of an effective amount of an oil-soluble benzene sulfonic acid comprising about 0.001 to 2.0 moles of an oil-soluble sulfonic acid per mole of amine. Preferably about 0.01 to 1.0 mole of an oil-soluble sulfonic acid per mole of amine is used to produce a highly active Mannich reaction product with low consumption of sulfonic acid.

The polyamine-Mannich products of this invention are preferably prepared by reacting an alkyl phenol or oxidized polymer with 0.1 to about 10 moles of formaldehyde-yielding reagent, and 0.1 to about 10 moles of amine each per mole of phenol or polymer. The condensation reaction is performed at a temperature from about ambient (25° C.) to about 160° C. by adding the formaldehyde-yielding reagent to a mixture of the phenol, the polyamine, and the sulfonic acid in an organic inert solvent such as benzene, xylene, toluene, or a solvent-refined mineral oil if needed to reduce viscosity. The reaction temperature can be raised to about 155° C. and held at that temperature until the reaction is complete, about 3 hours. Preferably, at the end of the reaction, the mixture is stripped with an inert gas, such as nitrogen, etc., until water produced by the condensation reaction and other volatiles have been removed.

Mannich polyamine reaction products of alkyl phenols or oxidized polymers with aldehydes (especially formaldehyde) and polyamines, polyalkylene polyamines, are described in the following U.S. patents, which are expressly incorporated by reference herein:

U.S. Pat. No. 3,413,347
U.S. Pat. No. 3,448,047
U.S. Pat. No. 3,539,663
U.S. Pat. No. 3,634,515
U.S. Pat. No. 3,697,574
U.S. Pat. No. 3,725,277
U.S. Pat. No. 3,725,480
U.S. Pat. No. 3,726,882
U.S. Pat. No. 3,787,458
U.S. Pat. No. 3,798,247
U.S. Pat. No. 3,872,019
U.S. Pat. No. 4,011,380

Improved products can be obtained by post-treating the Mannich reaction product with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

U.S. Pat. No. 3,036,003
U.S. Pat. No. 3,087,936
U.S. Pat. No. 3,200,107
U.S. Pat. No. 3,216,936
U.S. Pat. No. 3,254,025
U.S. Pat. No. 3,256,185
U.S. Pat. No. 3,278,550
U.S. Pat. No. 3,280,234
U.S. Pat. No. 3,281,428
U.S. Pat. No. 3,282,955
U.S. Pat. No. 3,312,619
U.S. Pat. No. 3,366,569
U.S. Pat. No. 3,367,943
U.S. Pat. No. 3,373,111
U.S. Pat. No. 3,403,102
U.S. Pat. No. 3,442,808
U.S. Pat. No. 3,455,831
U.S. Pat. No. 3,455,832
U.S. Pat. No. 3,493,520
U.S. Pat. No. 3,502,677
U.S. Pat. No. 3,512,093
U.S. Pat. No. 3,533,945
U.S. Pat. No. 3,539,633
U.S. Pat. No. 3,573,010
U.S. Pat. No. 3,579,450
U.S. Pat. No. 3,591,598
U.S. Pat. No. 3,600,372

U.S. Pat. No. 3,639,242
U.S. Pat. No. 3,649,229
U.S. Pat. No. 3,649,659
U.S. Pat. No. 3,658,836
U.S. Pat. No. 3,697,574
U.S. Pat. No. 3,702,757
U.S. Pat. No. 3,703,536
U.S. Pat. No. 3,704,308
U.S. Pat. No. 3,708,522

Generally, hydrocarbyl-substituted dicarboxylic acid compound-polyamine reaction products can be used to solubilize molybdenum compounds. The hydrocarbyl-substituted dicarboxylic acid compound is formed by the reaction of a substantially hydrocarbon compound and an unsaturated $C_{4-10}$ alpha-beta dicarboxylic acid, anhydride or ester, for example, furmaric acid, itaconic acid, maleic acid, maleic anhydride, chloromaleic acid, dimethylfumarate, or well known anhydrides or esters thereof etc.

Hydrocarbons useful in producing the hydrocarbyl substituent include chlorinated hydrocarbons, olefinically unsaturated polyolefins, and other reactive compounds which will combine with the unsaturated alpha-beta dicarboxylic acid forming at least one substantially hydrocarbyl substituent.

The reaction of an olefinically unsaturated hydrocarbon and an alpha-beta unsaturated dicarboxylic acid compound produces an alkenyl-substituted dicarboxylic acid compound which commonly contains a single alkenyl radical or a mixture of alkenyl radicals or other radicals variously bonded to the dicarboxylic acid or anhydride group wherein the alkenyl substituent contains from 8 to 800 carbons, preferably from about 15 to 300 carbons. Such anhydrides can be obtained by well known methods such as the well known ENE reaction between an olefin and a maleic anhydride or a halo succinic acid anhydride or succinic acid ester as taught in U.S. Pat. No. 2,856,876.

Suitable olefinically unsaturated hydrocarbons include octene, decene, dodecene, tetradecene, hexadecene, octadecene, eicosene and substantially viscous or atactic polymers of ethylene, propylene, 1-butene, 2-butene, isobutene, pentene, decene, and the like and halogen-containing olefins. The olefin may also contain cycloalkyl and aromatic groups. Preferred olefin polymers for reaction with the unsaturated alpha-beta dicarboxylic acid are polymers comprising a major amount of 50 mole % or greater a $C_{2-5}$ monoolefin or mixtures thereof, examples of said monoolefins include ethylene (ethene), propylene (propene), isobutylene (2-methylpropene), amylene, etc. The polymers can be homopolymers such as polyisobutylene or copolymers of two or more of said olefins such as ethylene-propylene polymers, ethylene-butylene polymers, isobutylene-butene polymers, etc. Other polymers include those in which a minor amount of the copolymer monomers include $C_{4-18}$ conjugated diolefins r $C_{5-18}$ nonconjugated diolefins. For example, ethylene-propylene-1,4-hexadiene, ethylene-propylene-5-ethylidene-2-norbornene terpolymers, etc.

The olefin polymers commonly have a number average molecular weight within the range of about 100 to about 100,000, more commonly, between 112 to about 11,000 and preferably 210–4200. Preferably, the olefin polymers have one double bond within 4 carbon atoms of a terminal carbon atoms per polymer. For reasons of high solubility, low cost, and ease of production, a polyisobutylene polymer having a molecular weight between 210 and 3,500 is exceptionally suited for the production of the polyamine-dicarboxylic acid reaction product.

Dicarboxylic acid compound-polyamine reaction products made by reacting the dicarboxylic acids described hereinabove with various types of amine compounds including polyamines are well known to those skilled in the art and are described, for example, in U.S. Patents:

U.S. Pat. No. 3,163,603
U.S. Pat. No. 3,184,474
U.S. Pat. No. 3,215,707
U.S. Pat. No. 3,219,666
U.S. Pat. No. 3,272,746
U.S. Pat. No. 3,281,357
U.S. Pat. No. 3,311,558
U.S. Pat. No. 3,316,177
U.S. Pat. No. 3,340,281
U.S. Pat. No. 3,341,452
U.S. Pat. No. 3,399,141
U.S. Pat. No. 3,415,750
U.S. Pat. No. 3,433,744
U.S. Pat. No. 3,444,170
U.S. Pat. No. 3,448,048
U.S. Pat. No. 3,448,049
U.S. Pat. No. 3,451,933
U.S. Pat. No. 3,467,668
U.S. Pat. No. 3,541,012
U.S. Pat. No. 3,574,101
U.S. Pat. No. 3,576,743
U.S. Pat. No. 3,630,904
U.S. Pat. No. 3,632,511
U.S. Pat. No. 3,725,441
U.S. Pat. No. Re 26,433

Polyamines which can be used to prepare the hydrocarbon soluble polyamine dicarboxylic reaction product include the polyamines described above in the discussion of the polyamine Mannich product.

Oxidizing agents which can be used to oxidize the polyamine-Mannich product or the reaction product of a polyamine and are unsaturated unsubstituted dicarboxylic acid compound are conventional oxidizing agents. Any oxygen containing material capable of releasing oxygen atoms or molecules under oxidizing conditions can be used. Examples of oxidizing agents which can be used under suitable conditions of temperature, concentration and pressure include oxygen, air, sulfur oxides such as sulfur dioxide, sulfur trioxide, etc., nitrogen oxides including nitrogen dioxide, nitrogen trioxide, nitrogen pentoxide, etc., peroxides such as hydrogen peroxide, sodium peroxide, percarboxylic acids and ozone. Other suitable oxidizing agents are the oxygen-containing gases such as various mixtures of oxygen, air, inert gases such as carbon dioxide, noble gases, nitrogen, natural gas, etc. Air, air with added oxygen or diluted air with reduced oxygen concentration containing less than the naturally occurring amount of oxygen are the preferred agents for reasons of economy, availability, and safety.

Sulfur compounds useful for producing the sulfurized products of this invention include solid, particulate, or molten forms of elemental sulfur or sulfur-yielding compounds such as sulfur, sulfur monochloride, sulfur dichloride, hydrogen sulfide, phosphorus pentasulfide, etc. Fine particulate or molten elemental sulfur is preferred for reasons of ease of handling, high reactivity, availability, and low cost.

The polyamine-Mannich compounds or the dicarboxylic acid compound-polyamine reaction products or sulfurized products thereof of this invention or sulfurized or unsulfurized precursors thereof can be oxidized according to U.S. Pat. Nos. 3,872,019 and 4,011,380, both of which disclose the oxidation of olefinic polymers for the production of lubricating oil additives. The oxidation can be accomplished by contacting the material to be oxidized, under suitable conditions of temperature and pressure, with an oxidizing agent such as air or free oxygen or any other oxygen-containing material, optionally mixed with a diluent or inert gas, capable of releasing oxygen under oxidation conditions. If desired, the oxidation can be conducted in the presence of known oxidation catalysts, such as platinum or platinum group metals, and compounds containing metals such as copper, iron, cobalt, cadmium, manganese, vanadium, benzene sulfonic acids, etc. Other oxidation processes are disclosed in U.S. Pat. Nos. 2,982,723; 3,316,177; 3,153,025; 3,365,499; and 3,544,520.

Generally, the oxidation can be carried out over a wide temperature range, depending on the oxidizing agent used; for example, with an active oxidizing agent hydrogen peroxide, temperatures in the range of −40° F. to 400° F. have been used while less active oxidizing agents, for example air or air diluted with nitrogen or process gas, temperatures in the range of 38°-427° C. (100°-800° F.) have been successfully used. The materials to be oxidized are generally dissolved in oil or other inert solvents prior to oxidation. Further, depending on the rate desired, the oxidation can be conducted at subatmospheric, atmospheric, or superatmospheric pressures, and in the presence of or absence of oxidation catalysts. The conditions of temperature, pressure, oxygen content of the oxidizing agent and the rate of introduction of the oxidizing agent, catalyst employed, can be correlated and controlled by those skilled in the art to obtain an optimum degree of oxidation as determined by desired molecular weight and the ability of the final product to combine with molybdenum.

Inert diluents useful in the oxidation include liquids stable to oxidation at elevated temperature such as lubricating oil fractions, polyisobutylene, etc. Polyamine Mannich or dicarboxylic acid compound-polyamine reaction product or precursors thereof are dissolved or suspended at a concentration of about 2 to 70 weight percent of the polymer in oil so that solution is not too viscous to be handled. Commonly, the solution can have a viscosity of from about 2,000-50,000 SUS at 38° C.

The material to be oxidized is then contacted with the oxygen-containing oxidizing agent, preferably comprising air or air diluted with an inert gas such as nitrogen at an elevated temperature comprising from about 38°-204° C. (100°-400° F.). The rate of addition of oxidizing agent to the reaction is controlled so that the oxidation occurs at the controlled rate and combustion does not occur. The oxidation commonly degrades the molecular weight and reduces solution viscosity of high molecular weight polymers. The degree of oxidation can conveniently be monitered by measuring solution viscosity, IR carbonyl absorbance or % polar compound as measured by liquid chromatographic techniques.

The polyamine Mannich or the dicarboxylic acid compound-polyamine reaction product or the oxidation product thereof can be sulfurized by contacting it with about 0.1-20, preferably 1-3 moles of sulfur or sulfur affording material per mole of oxidized product compound originally in the solution. Greater amounts of sulfur result in undesirable viscosity increase, dark color, and reduced ability to combine with molybdenum. Lesser amounts of sulfur provide little improvement. The temperature range of the sulfurization is generally about 50°-500° C., preferably for reduced degradation and high quality sulfurization the reaction is run at about 110°-250° C. Frequently sulfurization can be performed in the presence of catalysts added to the reaction to increase yield and rate of reaction. These catalysts include acidified clays, paratoluene sulfonic acids, a dialkyl phosphorodithioic acid and salts thereof, and a phosphorus sulfide.

The time required to complete sulfurization will vary depending on the ratios of reactants, reactant temperature, catalyst use and purity of reagents. The course of reaction can conveniently be monitored by following reaction vessel pressure or hydrogen sulfide evolution. The reaction can be considered complete when pressure levels off when evolution of hydrogen sulfide declines. Commonly, the reaction is run under an inert gas atmosphere, e.g., nitrogen, to prevent subsequent oxidation of the reaction product. At the end of the sulfurization, the product can conveniently be stripped of volatile materials and filtered of particulate matter.

In somewhat greater detail, the molybdenum compound is then reacted with the hydrocarbon-soluble polyamine compound. The molybdenum compounds can be added solid or in organic or aqueous solution or suspension however, one benefit of this invention is that these polyamine-molybdenum compounds can often be prepared with a single-organic phase reaction system. About 0.5-10 moles of molybdenum compound can be contacted per mole of amine in the polyamine hydrocarbon-soluble compound. Preferably, about equimolar amounts of molybdenum compound and hydrocarbon-soluble polyamine reaction product are used for reasons of rapid reaction, high performance of the molybdenum compound, and low consumption of molybdenum. The reaction can be run at temperatures from about 50° C. to 300° C., preferably at reflux at atmospheric pressure when water or low boiling organic solvents are present. Depending on reactant purity, reactant ratios, and temperature, the reaction commonly is complete in about 2-24 hours. At the end of the reaction, water and other volatile constituents can be stripped by heating and passing an inert gas through the reaction mixture. Commonly, the mixture can be filtered through celite to remove excess solid molybdenum and other undesirable solids.

The reactions detailed above can be performed in batch or continuous mode. In batch mode the reactant or reactants in appropriate diluent are added to a suitable vessel for reaction. The product is then withdrawn to appropriate strippers, filters and other purification apparatus. In continuous mode a stream of reactant or reactants is continuously combined at an appropriate rate and ratio in a vertical or horizontal reaction zone maintained at the reaction temperature. The reaction mixture stream is continuously withdrawn from the zone and is directed to appropriate strippers, filters and purification apparatus.

The reactants can be run neat (solventless) or in inert solvents or diluents such as hexane, heptane, benzene, toluene, lubricating oil, petroleum fractions, kerosene, ligroin, petroleum, ether, etc., optionally under an inert gas blanket such as nitrogen.

The above described molybdenum-polyamine reaction products of the present invention are effective additives for lubricating oil compositions when used in amounts of from about 0.1-90 weight percent based on the oil. Suitable lubricating base oils are mineral oils, petroleum oils, synthetic lubricating oils such as those obtained by polymerization of hydrocarbons and other well known synthetic lubricating oils, and lubricating oils of animal or vegetable origin. Concentrates of the additive composition of the invention in a suitable base oil containing about 10 to 90 weight percent of the additive based on the oil alone or in combination with other well known additives can be used for blending with the lubricating oil in proportions designed to produce finished lubricants containing 0.1 to 10 wt% of the product.

The above described molybdenum-polyamine reaction products are effective additives for gasolines when used in amounts from about 0.1 to about 10,000 parts of molybdenum per one million parts of gasoline for suppressing the octane requirement increase or reducing elevated equilibrium octane requirement in gasoline engines. At concentrations from about 100 to 10,000 parts of molybdenum per part of gasoline, the above molybdenum-containing reaction products act as friction modifying agents in internal combustion engines as the molybdenum oil concentration resulting from the molybdenum in "blow-by" gasses reaches about 0.1 to 1 wt.% based on the oil.

Concentrates of the additive composition of the invention in a suitable diluent hydrocarbon containing about 10 to 90 weight percent of the additive based on the diluent alone or in combination with other well known petroleum additives can be used for blending with lubricants, gasolines or other hydrocarbons in proportions designed to produce finished lubricants or gasolines containing 0.1 to 50,000 or greater parts of molybdenum per part of lubricant or gasoline.

The additives of this invention are often evaluated for dispersancy, antioxidation activity, and corrosion resistance using the Spot Dispersancy Test, the Hot Tube Test, and the AMIHOT Test.

In the Spot Dispersancy Test, the ability of the additive in the lubricating oil to suspend and disperse engine sludge was tested. To perform this test, an amount of engine sludge produced in a VC or VD engine test is added to a small amount of lubricant containing the additive to be tested. The sludge and additive are incubated in an oven at 149° C. for 16 hours. After this period, the mixture is spotted on a clean white blotter paper. The oil diffuses through the blotter paper carrying the sludge to some extent, depending on the dispersancy of the additive, forming an oil diffusion ring and a sludge diffusion ring. The dispersancy of the additive is measured by comparing the ratio of the radius of the oil diffusion ring to the radius of the sludge diffusion ring. The diameter of the sludge ring is divided by the diameter of the oil ring, and the result is multiplied by 100 and is presented as a percent dispersancy. The higher the number, the better dispersant property of the additive.

In the Hot Tube Test, the high temperature, varnish inhibiting properties of the additive are determined. A measured portion of the lubricating oil containing the additive in question is slowly metered into a 2 millimeter glass tube heated in an aluminum block. Through the tube is passed either nitrogen oxides or air at 201.7° C. or 257.2° C. During the test, the oil is consumed, and the ability of the additive to prevent the formation of varnish deposits is measured by the ability of the additive to prevent the formation of colored deposits on the interior surface of the tube. The tube is rated from 10 to 0 wherein 10 is perfectly clean and colorless and 0 is opaque and black.

In the AMIHOT Test, copper and lead coupons are placed in the tube containing a portion of lubricating oil containing the test additive product. To the oil is added a small amount of corrosive material such as hydrochloric acid, halogenated hydrocarbons, etc. The lubricant and coupons are heated in the tube to a temperature of about 162.8° C., and air is passed through the tube. The coupons are weighed prior to immersion in the oil and at the end of the test after cleaning with solvent. The ability of the additive to prevent corrosion of the coupons is reflected in the loss of weight of the coupons during immersion in the lubricating oil under test. The smaller the weight loss, the better the additive is in preventing acidic corrosion.

The gasoline soluble molybdenum compounds are tested for ORI suppression and Elevated Steady State Octane Requirement reduction using the CRC E-15 technique using primary reference fuels (PRF) and full boiling range reference unleaded fuels (FBRU) on an engine dynomometer. A GM 3.7 liter (2.31 cubic inch) V-6, and a Ford 2.3 liter (140 cubic inch) 4-cylinder in-line engine were connected to a load dynomometer. The fuel line is connected via a valve to a test fuel containing various concentration of molybdenum compound and other containers containing standard fuel having known octane numbers. The conditions of the test are as follows: the temperature of the coolant and oil is maintained at 93° C. (200° F.)±6° C. (10° F.), the temperature of the inlet air was 40° C.-49° C. (110° F.-120° F.), and the temperature of the transmission was maintained at 82° C. (180° F.)±6° C. (10° F.). The air fuel ratio was held at about stoichiometric, ignition timing and exhaust gas recirculation was maintained at the stock value. The engine was operated on fuel with and without gasoline soluble molybdenum(VI) compound for up to 30,000 equivalent miles. At intervals of 4,000 equivalent miles the standard test fuels were burned in the engine to determine the octane requirement of the engine. After the octane requirement was determined the engines were returned to the test fuel.

The following examples are illustrative of methods used in the preparation of the additives of this invention. The examples should not be used to unduly limit the scope of the invention.

EXAMPLE I

Into a 1-liter 3-neck flask equipped with a dropping funnel, reflux condenser, water trap, gas inlet tube, heater, and stirrer was charged 320 grams (0.1 moles, 50 percent active) of a polyisobutylenemonosubstituted phenol having an average molecular weight of about 1,600 in 125 grams of SX-5 oil, 17.4 grams (0.092 moles) of tetraethylene pentamine, and 17.6 grams (0.062 moles) of oleic acid. The mixture is stirred and heated to a temperature of 82° C. To the heated mixture was added 13.8 milliliters (1.86 moles of formaldehyde) of 37 wt.% aqueous formalin dropwise. Into the flask was directed a nitrogen stream and the temperature of the reaction mixture was slowly raised to 160° C. driving off water of reaction. The temperature of the reaction was maintained at 160° C. for three hours. At the end of the reaction, the product was cooled and was ready for use.

EXAMPLE II

In a 3-liter 3-neck flask equipped with a dropping funnel, reflux condenser, water trap, heater and stirrer was charged the product of Example I. The contents of the flask are heated to a temperature of 160° C. and 21.2 milliliters (2.90 moles) of formaldehyde in the form of 38 wt.% aqueous formalin were added dropwise. The reaction mixture was held at 160° C. for three hours under nitrogen stream after formalin addition was complete. At the end of the reaction, the mixture was cooled and is ready for use.

EXAMPLE III

Into a 5-liter 3-neck flask equipped with a reflex condenser, water trap, dropping funnel, heater and stirrer was charged 829 grams of a product similar to the product of Example I, and 660 grams of SX5 oil. The mixture is stirred and heated to 99° C. and 350 grams (5.65 moles) of boric acid and 175 grams of water are added. The mixture is stirred for 1 hour and then the temperature of the mixture is raised to 171° C. for 4 hours to remove water. At the end of this time, the mixture is filtered and is ready for use.

Into a 5-liter reaction flask complete with a dropping funnel, reflux condenser, water trap, heater, and stirrer is charged 92 parts of the product of Example II, 6 parts of the product prepared above in Example III and 2 parts of SX5 oil. The mixture is stirred and heated to a temperature of 104° C. and permitted to react for 14 hours.

EXAMPLE IV

In a 1-liter 3-neck flask equipped with a reflux condenser, dropping funnel, water trap, and gas inlet tube was charged 400 grams of the product of Example I, 18.4 grams (0.128 moles) of molybdic oxide and 16 grams of water. The mixture was stirred and heated under a nitrogen atmosphere to a temperature of 93°-99° C. for 6 hours. After this period, the water was removed by nitrogen stripping at 149° C. The product was filtered and contained 1.13 wt.% nitrogen and 2.9 wt.% molybdenum.

EXAMPLE V

Example IV was repeated except that 400 grams of the product of Example II, 21.2 grams (0.147 moles) of molybdic oxide, and 20 grams of water were used in place of the proportions used in Example IV.

EXAMPLE VI

Example IV was repeated except that 500 grams of the product of Example III, 19.7 grams (0.137 moles) of molybdic oxide, and 20 grams of water were used in place of the proportions used in Example IV.

EXAMPLE VII

To a 500 milliliter Erlenmeyer flask equipped with a magnetic stirrer and heater was charged 54 grams (0.375 moles) of molybdic oxide, 106 grams of water and 22.5 grams (0.371 moles) of 28 percent aqueous ammonia. The mixture was stirred and heated until dissolution. The ammonium molybdate product was charged to a 3-liter 3-neck flask equipped with a reflux condenser, water trap, dropping funnel and gas inlet tube, containing 500 ml of n-heptane and 1,000 grams of a Mannich product comprising the reaction of a polyisobutylene substituted phenol having a molecular weight of about 600, aqueous formaldehyde, diethylene triamine and oleic acid. The mixture was stirred and heated to reflux for 4.25 hours. Water of reaction was removed by azeotropic distillation and solids remaining in solution were centrifuged. The product was filtered and stripped of heptane by heating to 138° C. with a nitrogen stream. The product contained 2.2 wt.% molybdenum, 1.31 wt.% nitrogen, and had a 40° C. viscosity of 2516 SSU.

EXAMPLE VIII

To a 2-liter 3-neck flask equipped with a dropping funnel, reflux condenser, gas inlet tube and water trap were charged 2500 grams of a product similar to the product of Example II, 77.3 grams (0.537 moles) of molybdic oxide and 80 grams of water. The mixture was heated under nitrogen to 93°-99° C. for 6 hours. After this period, water was removed by nitrogen stripping and had a temperature of 149° C. The product was filtered through celite and was ready for use. In a 1-liter 3-neck flask equipped with a reflux condenser, dropping funnel, gas inlet tube and water trap were charged 500 grams of the above product and 14.8 grams (0.336 moles) of carbon disulfide. The mixture was mixed for 1.5 hours as the temperature was slowly raised to 149° C. during this period. The temperature was maintained for 1 hour and at the end of this period the product was filtered and contained 1.25 wt.% nitrogen, 1.2 wt.% sulfur, and had a viscosity at 99° C. of 2423 SSU.

EXAMPLE IX

Example VIII was repeated except that 3.38 grams of ditertiary nonyl polysulfide was substituted for the 4.8 grams of carbon disulfide. The product contained 1.33 wt.% nitrogen, 2.6 wt.% sulfur, and had a 99° C. viscosity of 1597 SSU.

EXAMPLE X

The procedure of Example VIII was repeated except that 12.5 grams (0.39 moles) of sulfur were substituted for the 14.8 grams of carbon disulfide. The product contained 1.56 wt.% nitrogen and had a 99° C. viscosity of 2471 SSU.

EXAMPLE XI

To a 2-liter 3-neck flask equipped with a reflux condenser, dropping funnel, nitrogen inlet tube, and water trap were charged 1,004 grams (2.94 moles) of a $C_{15-20}$ alkenyl succinic anhydride and 429 grams (2.94 moles) of triethylene tetraamine. The mixture was stirred and heated slowly to a temperature of 177° C. while water reaction was azeotropically removed with nitrogen stream.

To a 200 grams portion of the above product was slowly added 433 grams of a molybdic acid solution prepared by heating 110.25 grams of (0.77 moles) molybdic oxide, 441 grams of water, and 52.5 grams (0.656 moles) of 50% aqueous sodium hydroxide to 77° C. until the solids dissolved. The solution was cooled to 54° C. and 32.1 grams (0.32 moles) of 98% sulfuric acid were added. Water was removed azeotropically and the product formed a gel. The product contained 7.1 wt.% nitrogen and 6.8 wt.% molybdenum.

EXAMPLE XII

In a 2-liter 3-neck flask equipped with a reflux condenser, dropping funnel and water trap were charged 686 grams (2.62 moles) dodecyl phenol, 79 grams (1.32 moles) of ethylene diamine, 106 grams (1.31 moles) of 37 wt.% aqueous formaldehyde. The mixture was stirred and heated to a temperature of 149° C. under a nitrogen atmosphere and water was removed by distillation. The reaction mixture was held at that temperature for 2 hours and diluted with 804 grams of SX-5 oil.

EXAMPLE XIII

To a 400 gram portion of the product of Example XII was added 200 ml of n-heptane and 271.4 grams of molybdic acid solution prepared by heating 110.25 grams (0.77 moles) of molybdic oxide, 441.0 grams of water and 52.5 grams of 50% aqueous sodium hydroxide and neutralizing the resulting solution with 32.1 grams (0.32 moles) of sulfuric acid. The mixture was refluxed for 4 hours. Water was removed by azeotropic distillation and the dilute product filtered through celite. The product contained 3.0 wt.% molybdenum and 1.32 wt.% nitrogen.

EXAMPLE XIV

To a 1-liter flask equipped with a reflux condensor, water trap, dropping funnel, and a gas inlet tube was charged a 400 gram portion of the product from Example XII and 42 grams sulfur. The mixture was stirred and heated to 149° C. The reaction was maintained at this temperature for 2 hours. To 210 grams of the above product was added 271.4 grams of a molybdic acid solution (described in Example XIII) and 200 ml n-heptane. The mixture was refluxed for 4 hours, water was stripped, the product was filtered, and solvent was removed. The product contained 0.5 wt.% molybdenum, 0.37 wt.% nitrogen and 5.0 wt.% S.

EXAMPLE XV

Example XII was repeated except that after the reaction of the phenol, the amine, and the formaldehyde and after stripping the water, the reaction mixture was blown with air at a rate of 500 milliliters per minute at 149° C. for 7.5 hours. To 400 grams of the above product was added 200 grams of n-heptane and 271.4 grams of a molybdic acid solution (dissolved in Example XIII). The mixture was refluxed for 4 hours, water was stripped, the mixture was filtered and solvent was removed. The product contained 3.5 wt.% molybdenum and 0.77 wt.% nitrogen.

EXAMPLE XVI

In a 2-liter 3-neck flask equipped with a reflux condenser, water trap, dropping funnel, nitrogen inlet tube, stirrer, and heater was charged 686 grams of dodecyl phenol, 79 grams of ethylene diamine and 212 grams of 37 wt.% aqueous formaldehyde. The mixture was stirred and heated to a temperature of 149° C. Water was removed by distillation for 2 hours and the temperature was then raised to 350° F. and air was sparged through the mixture at a rate of 500 milliliters per minute for 8 hours. At the end of this time, the reaction mixture was diluted with 843 grams of SX5 oil. To 750 grams of the diluted product was added 56 grams of elemental sulfur. The mixture was stirred and heated for 2 hours at 350° F. At the end of this period, the mixture was cooled and was ready for use. To 700 grams of the above product was added 350 grams n-heptane and 518.2 grams of a molybdic acid solution (described in Example XIII). The solution was refluxed, water was stripped, the mixture was filtered and solvent was removed. The product contained 1.2 wt.% Mo, 1.04 wt.% nitrogen, and 3.19% sulfur.

TABLE I

| Shell 4-Ball Test[3] (lower number means reduced friction) | | |
|---|---|---|
| Product | Coefficient of Friction | wt % Mo |
| EX V[2] | 0.045 | 0.080 |
| EX XIII[1] | 0.049 | 0.048 |
| EX XIII[1] | 0.052 | 0.100 |
| EX II[2] | 0.072–0.076 | 0.000 |
| EX III[1] | 0.076 | 0.000 |

[1]Oil Blend: 3.77% Mannich, 0.23 wt. % anti-foam (silicone), 0.99 wt. % for dialkyl dithiophosphate, 0.74 wt. % magnesium sulfonate (overbased), 2.58 wt. % calcium sulfonate, plus molybdenum additive to reach above concentrations of Mo, 50/50 SX-5/SX-10 oil.

[2]Oil Blend: 4.1 wt. % product of example, 1.1 wt. % zinc dialkyl dithiophosphate, 0.1 wt. % anti-foam (silicone), 1.4 wt. % overbased magnesium sulfonate, 1.1 wt. % calcium phenate, 7.2 wt. % polymethacrylate viscosity index improver, 29.8 wt. % SX-5 oil, 55.2 wt. % SX-10 Oil.

[3]Standard test for metal to metal friction.

TABLE II

| Hot Tube Test (10 = best, 1 = worst) | | |
|---|---|---|
| PROD OF EX.[4] | AIR | $NO_x$ |
| I | 1.5 | 3.5 |
| II | 3.5 | 4.0 |
| III | 3.0 | 4.0 |
| VI | 5.0 | 6.0 |
| V | 4.0 | 7.0 |
| IV | 4.0 | 7.5 |
| VIII | 4.0 | 9.0 |
| IX | 4.0 | 8.0 |
| X | 4.0 | 7.0 |

[4]Oil blend: 1.1 wt. % zinc dialkyl dithiophosphate, 0.10 wt. % silicone anti-foam, 1.4 wt. % overbased magnesium sulfonate, 1.1 wt. % calcium phenate, 7.2 wt. % polymethacrylate viscosity index improver, 79.8 wt. % SX-5 oil, 55.2 wt. % SX-10 oil, 4.1 wt. % product of Example.

TABLE III

| Spot Dispersancy (100 = best) | | | | |
|---|---|---|---|---|
| | % Dispersancy in Sludge Oil | | | |
| | A % Dispersant | | B % Dispersant | |
| PROD OF | 2 | 4 | 4 | 6 |
| EX I | 79 | 92 | | |
| EX II | 82 | 100 | 76 | 84 |
| EX III | 62 | 75 | | |
| EX IV | 80 | 84 | | |
| EX V | 70 | 77 | 53 | 50 |
| EX VI | 57 | 68 | | |
| EX VIII | | | 60 | 78 |
| EX IX | | | 57 | 79 |
| EX X | | | 62 | 80 |
| Sludge Oil Blank | 45 | | 46 | |

TABLE IV

| AMIHOT Test[5] (−0.0 = best) | | |
|---|---|---|
| PROD OF | Δ Pb (mg) | Δ Cu (mg) |
| EX I | −1.5 | −1.8 |
| II | −13.8 | −.03 |
| III | −0.4 | −1.4 |
| IV | −1.5 | −6.9 |
| V | −15.5 | −5.1 |

TABLE IV-continued

| PROD OF | AMIHOT Test[5] (−0.0 = best) Δ Pb (mg) | Δ Cu (mg) |
|---|---|---|
| VI | −0.4 | −2.1 |

[5]Test Blend: 0.86 wt. % SX-5 oil, 72.65 wt. % Sun 510N, 21.80 wt. % Sun 150 Bright Stock, 0.47 wt. % overbased magnesium sulfonate, 0.83 wt. % zinc dialkyl dithiophosphate, and 3.40 wt. % product of Example.

TABLE V

OCTANE REQUIREMENT INCREASE SUPPRESSION OR STEADY STATE OCTANE REQUIREMENT REDUCTION 3.7 L 6 M Engines

| | EQUIVALENT MILES ($\times 10^3$) | OPI SUPPRESSION | ORI (OCTANE REQUIREMENT INCREASE) |
|---|---|---|---|
| BLANK (0.0 ppm Mo) | 0–12 | — | 6.5 |
| EXAMPLE VII (4.5 ppm Mo) | 0–16 | 1.5 | 5.0 |
| 2.3 L Ford Engine | | | |
| BLANK | 0–11 | — | 7.5 |
| EXAMPLE VII (3.0 ppm Mo) | 0–2 | 4.5 | 3.0 |

An examination of the Tables I–IV shows that the incorporation of the molybdenum in the polyamine compound reduces the friction when used in lubricants. The overall deposit reducing and dispersancy properties of the polyamine compound is improved in the Hot Tube Test, and not substantially reduced in the Spot Dispersancy Test and the AMIHOT Test.

Since many embodiments of the invention can be made the invention resides solely in the claims hereinafter appended.

We claim:

1. An improved hydrocarbon-soluble molybdenum composition which comprises reaction product of a molybdenum compound and a sulfurized hydrocarbon-soluble polyamine compound wherein a hydrocarbon-soluble polyamine compound is reacted with sulfur or a sulfur-yielding compound to produce a sulfurized hydrocarbon-soluble polyamine compound prior to reaction with the molybdenum compound, said reaction product of a molybdenum compound and a sulfurized hydrocarbon-soluble polyamine compound being obtained at a temperature within the range of about 50° C. to 300° C. and a mole ratio within the range of about 0.5 to 10 moles of molybdenum compound per mole of amine in the sulfurized hydrocarbon-soluble polyamine compound, said molybdenum compound being a compound which produces ammonium molybdate, molybdic acid, and/or molybdic oxide under reaction conditions, and said hydrocarbon-soluble polyamine compound being selected from substituted dicarboxylic acid compound-polyamine reaction products, or sulfurized and/or oxidized derivatives thereof, wherein said substituted dicarboxylic acid compound of said substituted dicarboxylic acid compound-polyamine reaction products comprises a hydrocarbyl-substituted succinic acid compound.

2. A lubricant comprising a lubricating base oil and an effective friction modifying amount of the hydrocarbon-soluble molybdenum composition of claim 1.

3. A gasoline containing sufficient hydrocarbon-soluble polyamine molybdenum composition to supply about 0.1–10,000 parts of molybdenum per one million parts of gasoline, wherein said hydrocarbon-soluble polyamine molybdenum composition is a reaction product of a molybdenum compound and a sulfurized hydrocarbon-soluble polyamine compound wherein a hydrocarbon-soluble polyamine compound is reacted with sulfur or a sulfur-yielding compound to produce a sulfurized hydrocarbon-soluble polyamine compound prior to reaction with the molybdenum compound, said reaction product of a molybdenum compound and a sulfurized hydrocarbon-soluble polyamine compound being obtained at a temperature within the range of about 50° C. to 300° C. and a mole ratio within the range of about 0.5 to 10 moles of molybdenum compound per mole of amine in the sulfurized hydrocarbon-soluble polyamine compound, said molybdenum compound being a compound which produces ammonium molybdate, molybdic acid, and/or molybdic oxide under reaction conditions, and said hydrocarbon-soluble polyamine compound being selected from substituted dicarboxylic acid compound-polyamine reaction products, or sulfurized and/or oxidized derivatives thereof, wherein said substituted dicarboxylic acid compound of said substituted dicarboxylic acid compound-polyamine reaction products comprises a hydrocarbyl-substituted succinic acid compound.

* * * * *

UNITED STATES PATENT OFFICE
CERTIFICATE OF CORRECTION

Patent No. 4,500,439 Dated February 19, 1985

Inventor(s) C. Thomas West and Robert J. Basalay

It is certified that error appears in the above-identified patent and that said Letters Patent are hereby corrected as shown below:

Patent reads:

| Col. | Line | |
|---|---|---|
| 5 | 57 | "diolefins r" and should read --diolefins or-- |
| 8 | 9 | "$110^{o}$" and should read --$100^{o}$-- |

Signed and Sealed this

*Nineteenth* Day of *November 1985*

[SEAL]

*Attest:*

DONALD J. QUIGG

*Attesting Officer*

*Commissioner of Patents and Trademarks*